US006984157B2

(12) United States Patent
Campbell

(10) Patent No.: US 6,984,157 B2
(45) Date of Patent: Jan. 10, 2006

(54) MOTOR MOUNTING MECHANISM

(76) Inventor: James S. Campbell, 3705 Sapona Trail, Pfafftown, NC (US) 27040

( * ) Notice: Subject to any disclaimer, the term of this patent is extended or adjusted under 35 U.S.C. 154(b) by 0 days.

(21) Appl. No.: 10/434,328

(22) Filed: May 12, 2003

(65) Prior Publication Data

US 2004/0229523 A1 Nov. 18, 2004

(51) Int. Cl.
*B63H 5/125* (2006.01)

(52) U.S. Cl. ..... 440/56; 440/6

(58) Field of Classification Search ..... 440/6, 440/7, 53, 55, 56

See application file for complete search history.

(56) References Cited

U.S. PATENT DOCUMENTS 4,077,353 A * 3/1978 Webb, Jr. ..... 440/55
4,371,349 A * 2/1983 Edwards ..... 440/56
4,637,332 A * 1/1987 Glime ..... 114/61.23
4,734,068 A * 3/1988 Edwards ..... 440/56

* cited by examiner

*Primary Examiner*—Sherman Basinger

(57) ABSTRACT

A protective motor mounting mechanism for motors and propellers mounted at the lower end of a shaft and in the water which includes a clamp for fastening the rotor mechanism to the motor shaft and a stator mounted to a fixed cross piece and a release lever portion. The rotor and stator cooperatively engage with other to maintain the shaft in a vertical position and place the motor and propeller in a force exerting condition in the water. A release lever is connected to the stator and is biased by a helical spring to and upward and connected position. The release lever is movable to a motor and stator disconnected position and the motor shaft, motor and propeller lifts out of the water. If the motor or propeller strike an object in the water while in the force exerting condition, the spring bias is overcome and the motor shaft, motor and propeller mechanism are removed from the water.

19 Claims, 10 Drawing Sheets

MOTOR MOUNTING MECHANISM

BACKGROUND OF THE INVENTION

1. Field of the Invention

This invention relates generally to boat motors and motor mounting mechanisms such as those utilized in recreational fishing for propelling boats at slow speeds to enable fisherman to quietly explore selected fishing areas, and more particularly, to a yieldable protective mounting mechanism for motors mounted on elongated motor shafts with the motor and propeller mechanism at the lower end of the motor shaft and in the water which provides yieldable support and pivotal rotation of the motor and propeller mechanism in the event submerged articles are struck to prevent damage to the motor shaft, the motor or the propeller mechanism.

2. Description of Prior Art

Boat motors, particularly trolling motors, are widely utilized in recreational fishing to enable fishermen to propel fishing boats quietly at slow speed and thereby enable exploration of areas of lakes, streams, bays and the like. Typically such motors are provided with a bracket for attachment to the bow or stern of a fishing boat or other such vessel and have an elongated shaft extending through a motor support bracket with a motor and propeller mechanism secured to the lower end of the shaft. In most cases the motor shaft is vertically slidable within the motor support bracket so that the electric motor and propeller may sit at any suitable depth in the water that is permitted by the length of the shaft and the height of the boat above the water line.

Many motor support brackets are provided with features that enable the motor and shaft to be stowed above the level of the water in a generally horizontal position when not in use. Those trolling motor mounts that are adapted to be fixed to the bow of the boat are generally quite complex and expensive because the bow of small fishing and pleasure boats is not ordinarily provided with a trolling motor mounting bracket. The motor mount for bow mounted trolling motors is quite complex in construction because motor support positioning and stowage is typically built into the mount. Some of these trolling motor mount mechanisms additionally enable pivoting or other movement of portions of the trolling motor mechanism in the event a submerged object is struck. For the most part, however, these mechanisms are complex and expensive. Many fisherman and other small boat users employ simple and inexpensive trolling motor assemblies that incorporate simple clamp motor support brackets which are designed for clamped assembly to the transom at the stem of a boat.

In most cases, clamp stern mounting brackets fix the motor with its shaft disposed in a substantially vertical position so that the motor shaft is rotatable relative to its mounting bracket but not pivotal. These non-pivotal trolling motor mount mechanisms though quite simple and inexpensive do not provide any protection against shaft bending or motor or propeller mechanism damage when a submerged article is struck.

It is therefore desirable to provide a yieldable protective mounting mechanism for motors and propeller mechanisms mounted at the lower end of the elongated motor shaft and in the water which will provide the motor and propeller mechanism with protective yielding pivotal movement when a submerged object is struck to minimize the possibility of damage. It is also desirable to provide a motor mounting mechanism that will support a wide range of motors which is simple in design and inexpensive to build. It is to these desired objectives that the present invention is directed.

OBJECTIVES AND SUMMARY OF THE INVENTION

It is primary feature of the present invention to provide a novel protective motor mounting mechanism to be secured to a fishing boat or other small marine vessel which is adapted to receive and provide support for a trolling motor.

Another feature of the present invention is to provide a novel protective yielding motor mounting mechanism which permits pivotal movement of the motor and propeller mechanism to minimize the damage to the shaft, motor and propeller mechanism in the event a submerged object is struck.

Yet another objective of the present invention is to provide a novel protective mounting mechanism that can be secured to a cross piece extending from the gunnel on one side of the boat to the gunnel on the other side.

A further objective of the present invention is to provide a novel protective motor mounting mechanism that can be manually operated to rotationally displace the motor and propeller mechanism from the water to an inactive, stored position and back to an active, immersed position.

The present invention is a yieldable protective mounting mechanism for motors and propeller mechanisms mounted at the lower end of elongated motor shafts and in the water which includes a clamp part for releasably securing the rotor mechanism to the motor shaft and a stator mounted to a fixed cross piece and a release lever receiving portion. The rotor and stator cooperatively engage with each other through cooperatively connecting elements which maintain the motor shaft in a substantially vertical position and place the motor and propeller mechanism in a force exerting condition in the water. A spring holding member extends through the rotor into the stator, and a helical spring fits around the spring holding member so that it is biased to hold the releasably secured rotor and stator connecting elements in tight contact. A release lever is movably connected to the stator and normally biased by the spring to an extended or upward and connected position.

The release lever is movable to a depressed and rotor and stator disconnected position to disconnect the connecting elements and permit displacement of the motor shaft and carried motor and propeller mechanism from the water.

When the elongated motor shaft carrying a motor and propeller mechanism at its lower end is vertical with the motor and propeller mechanism submerged and in a force exerting condition, the boat moves in the direction controlled by the positioning of the motor and propeller mechanism in the water. Should the motor or propeller strike an object in the water, the spring holding member bias is overcome, the rotor connecting elements are separated. And the motor shaft, motor and and propeller mechanism are displaced from the water.

Thus there has been outlined the more important features of the invention in order that the detailed description that follows may be better understood and in order that the present contribution to the art may be better appreciated. There are, of course, additional features of the invention that will be described hereinafter and which will form the subject matter of the claims appended hereto. In that respect, before explaining at least one embodiment of the invention in detail, it is to be understood that the invention is not limited in its arrangement of the components set forth in the following description and illustrated in the drawings. The invention is capable of other embodiments and of being practiced and carried out in various ways.

It is also to be understood that the phraseology and terminology employed herein are for the purpose of description and should not be regarded as limiting in any respect. Those skilled in the art will appreciate that the concept upon which this disclosure is based may readily be utilized as a basis for designing other structures, methods and systems for carrying out the several purposes of this development. It is important that the claims be regarded as including such equivalent methods and products resulting therefrom that do not depart from the spirit and scope of the present invention. The application is neither intended to define the invention, which is measured by its claims, nor to limit its scope in any way.

Thus, the objects of the invention set forth above, along with the various features of novelty which characterize the invention, are noted with particularity in the claims annexed to and forming a part of this disclosure. For a better understanding of the invention, its operating advantages and the specific results obtained by its use, reference should be made to the following detailed specification taken in conjunction with the accompanying drawings wherein like characters of reference designate like parts throughout the several views.

The drawings are included to provide a further understanding of the invention and are incorporated in and constitute a part of this specification. They illustrate embodiments of the invention and, together with their description, serve to explain the principles of the invention.

DESCRIPTION OF THE PREFERRED EMBODIMENT

Figure 1:
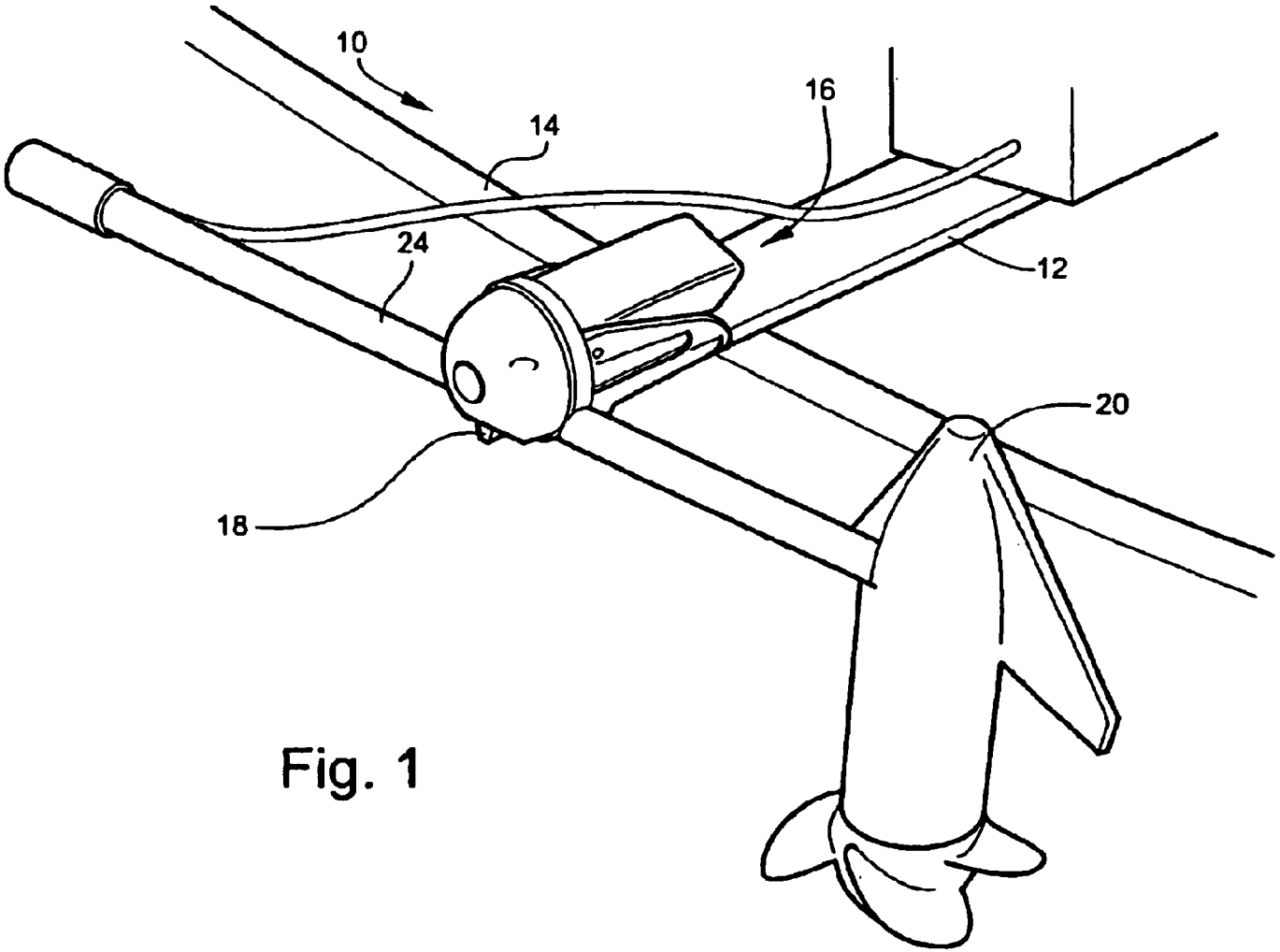
FIG. 1 is a perspective partial view of a boat equipped with the mounting mechanism of the present invention with the elongated motor shaft, motor and propeller mechanism at the lower end of the motor shaft being in the inactive position and condition out of the water.
Figure 2:
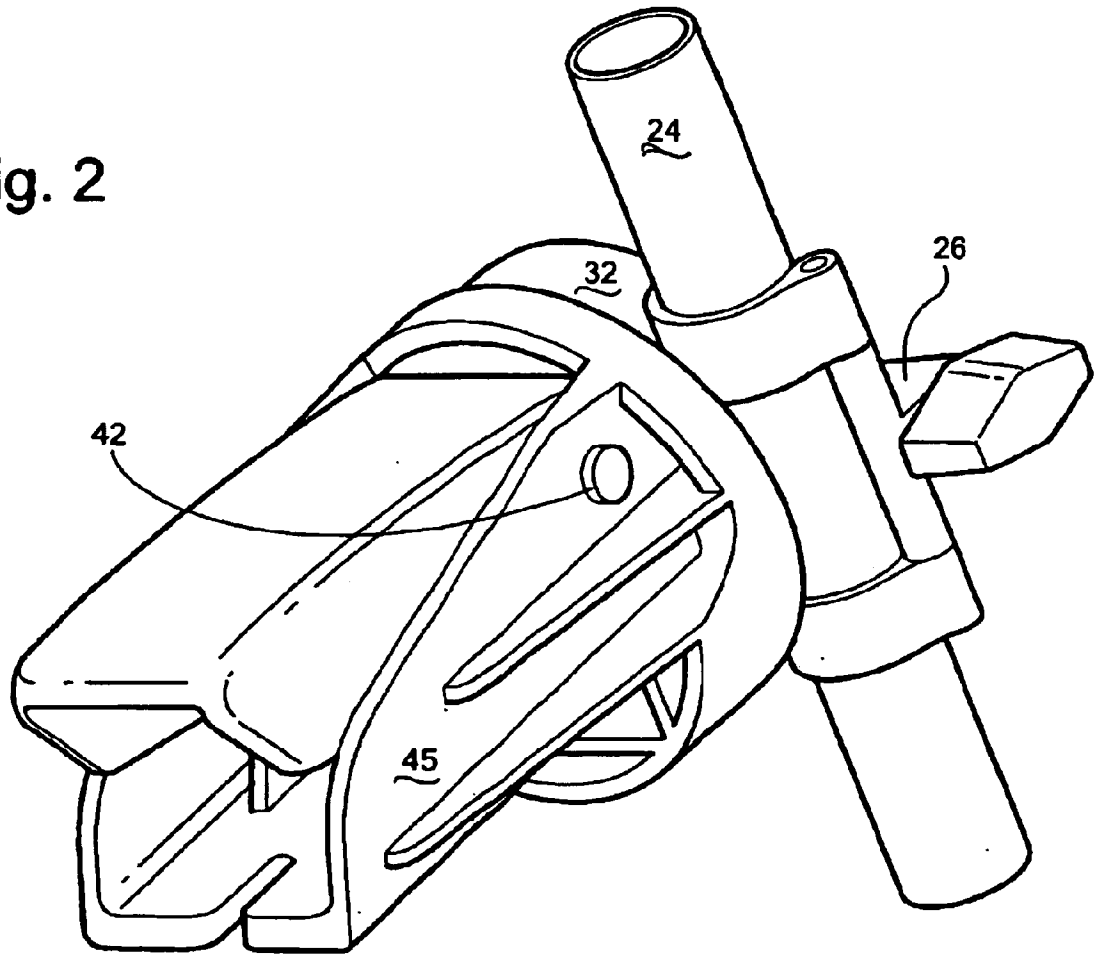
FIG. 2 is a downward perspective view of the mounting mechanism of the present invention secured to the elongated motor shaft.
Figure 3:
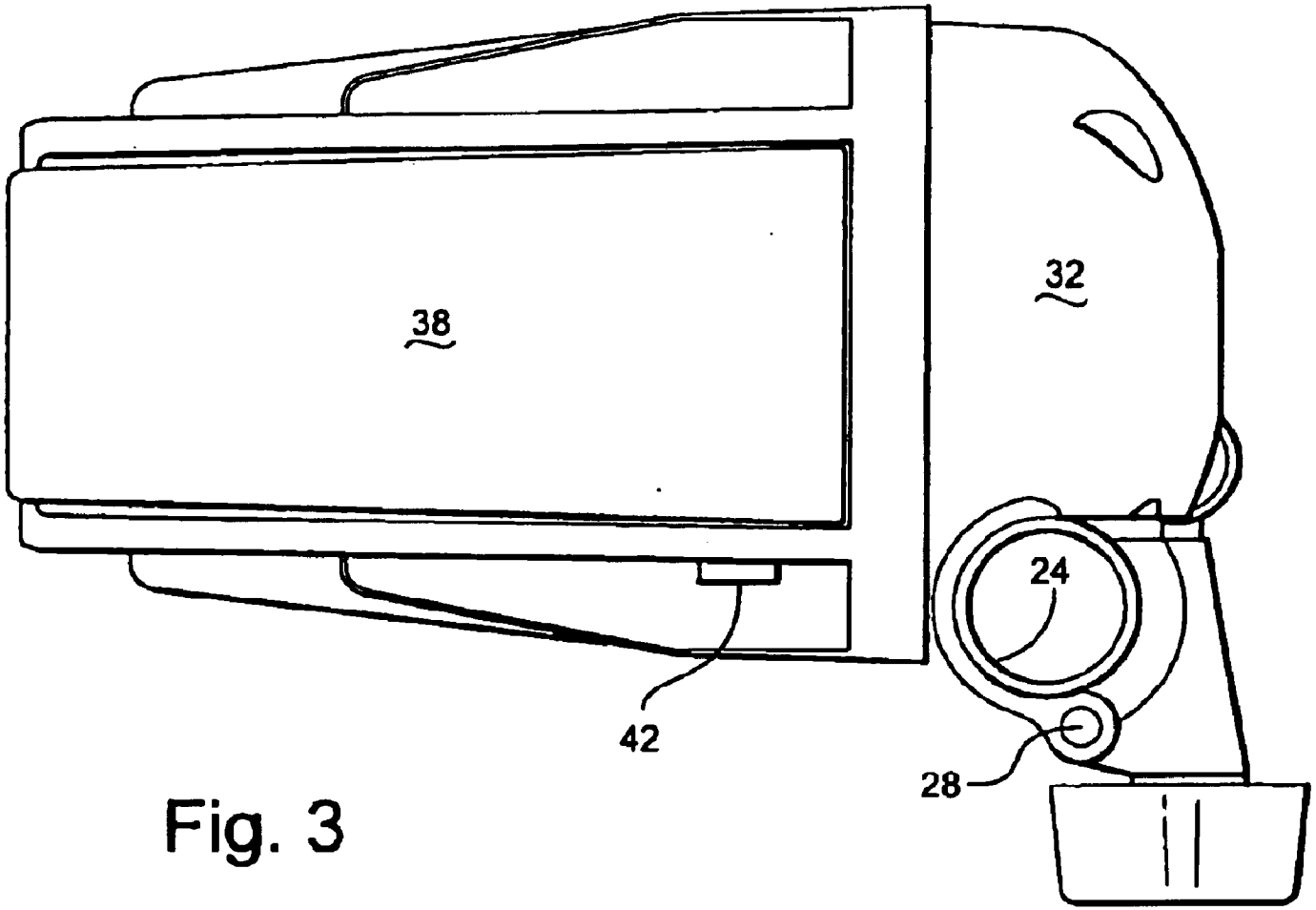
FIG. 3 is a top plan view of the mounting mechanism of the present invention.

Referring now to the drawings and particularly to FIG. 1, a boat shown generally as 10 has a gunnel connecting member 12 clamped at each gunnel 14 to secure member 12 to boat 10 and to support the protecting mounting mechanism of the present invention shown generally as 16. Mechanism 16 pivots about spring holding member 18 when motor 20 and propeller mechanism 22 are moved into and out of the water.

Figure 4:
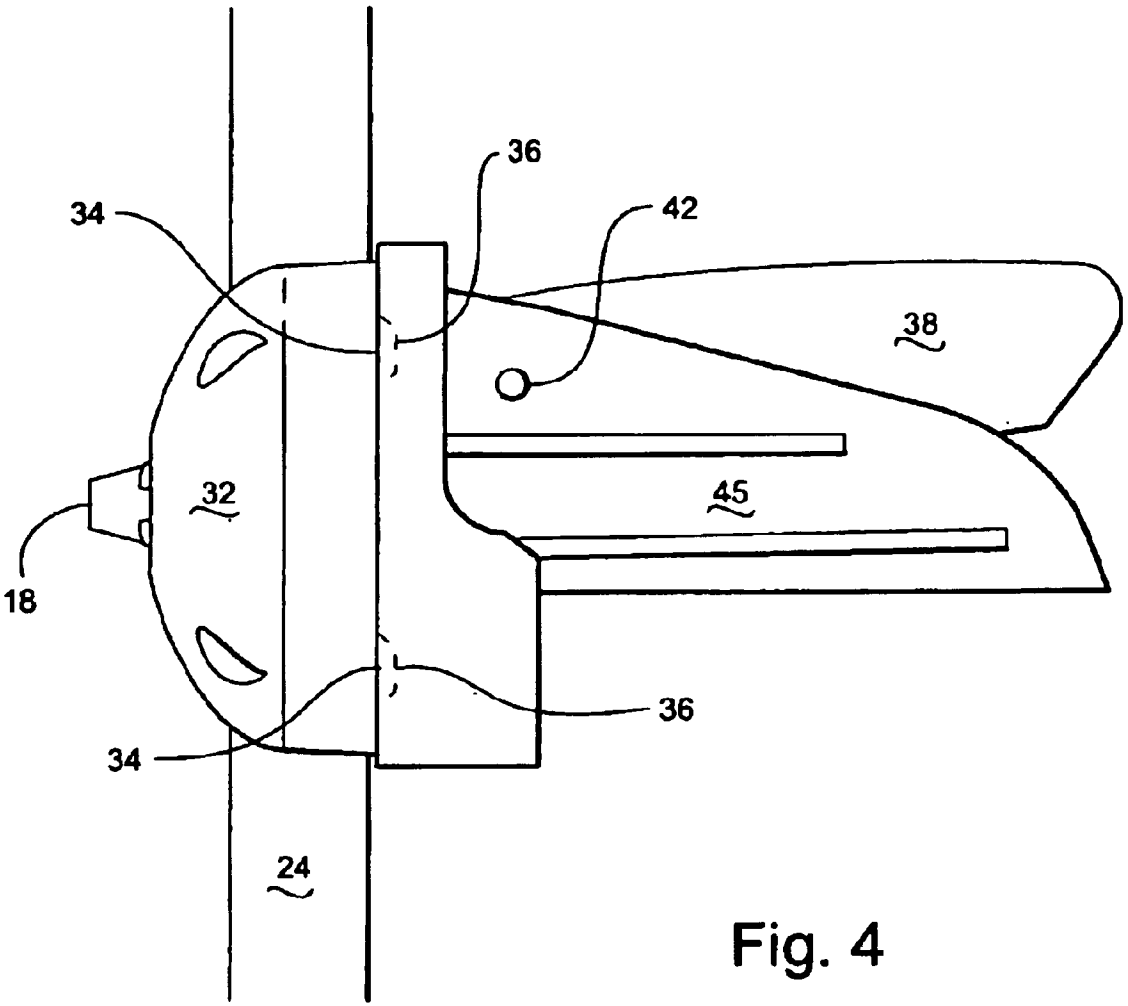
FIG. 4 is a side elevational view of the mounting mechanism of the present invention shown in the force-exerting condition.
Figure 5:
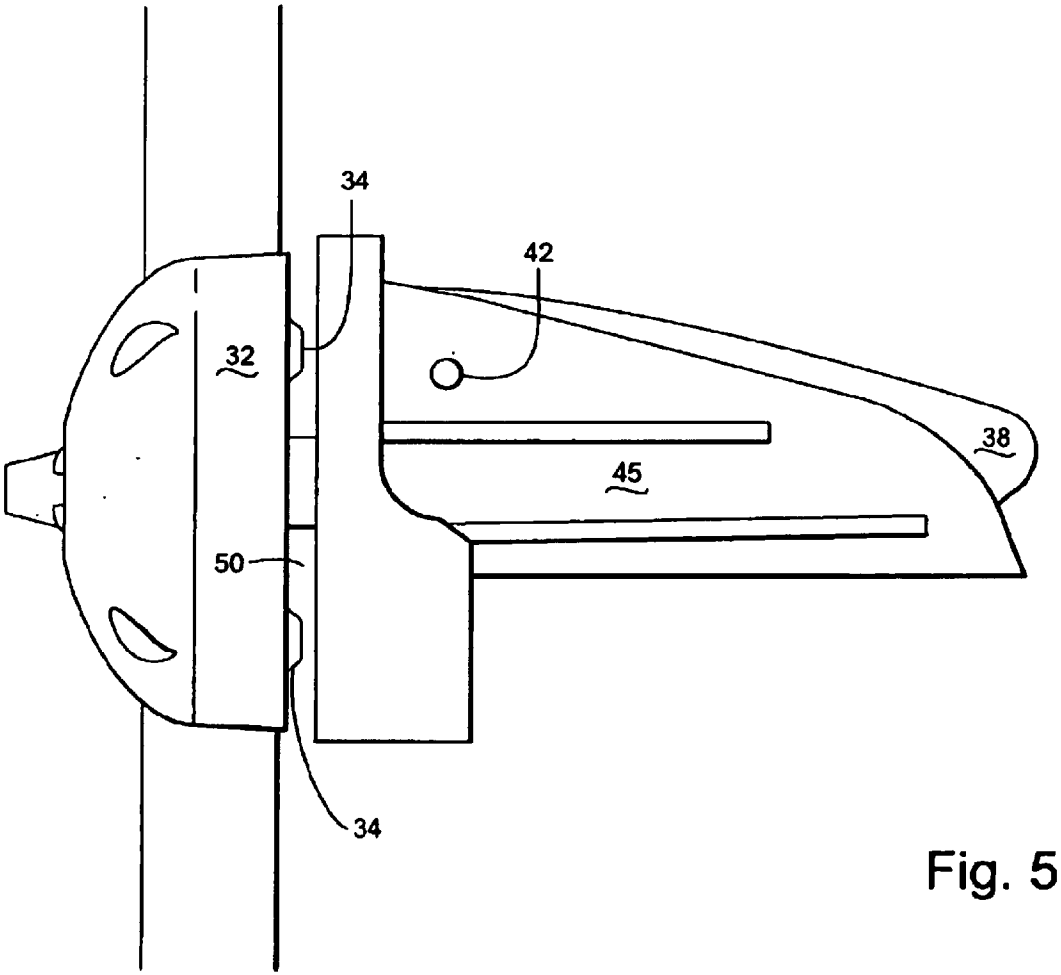
FIG. 5 is a side elevational view of the mounting mechanism of the present invention shown in the rotor and stator disconnected position to permit removal of the motor shaft and carried motor and propeller mechanism from the water.
Figure 6:
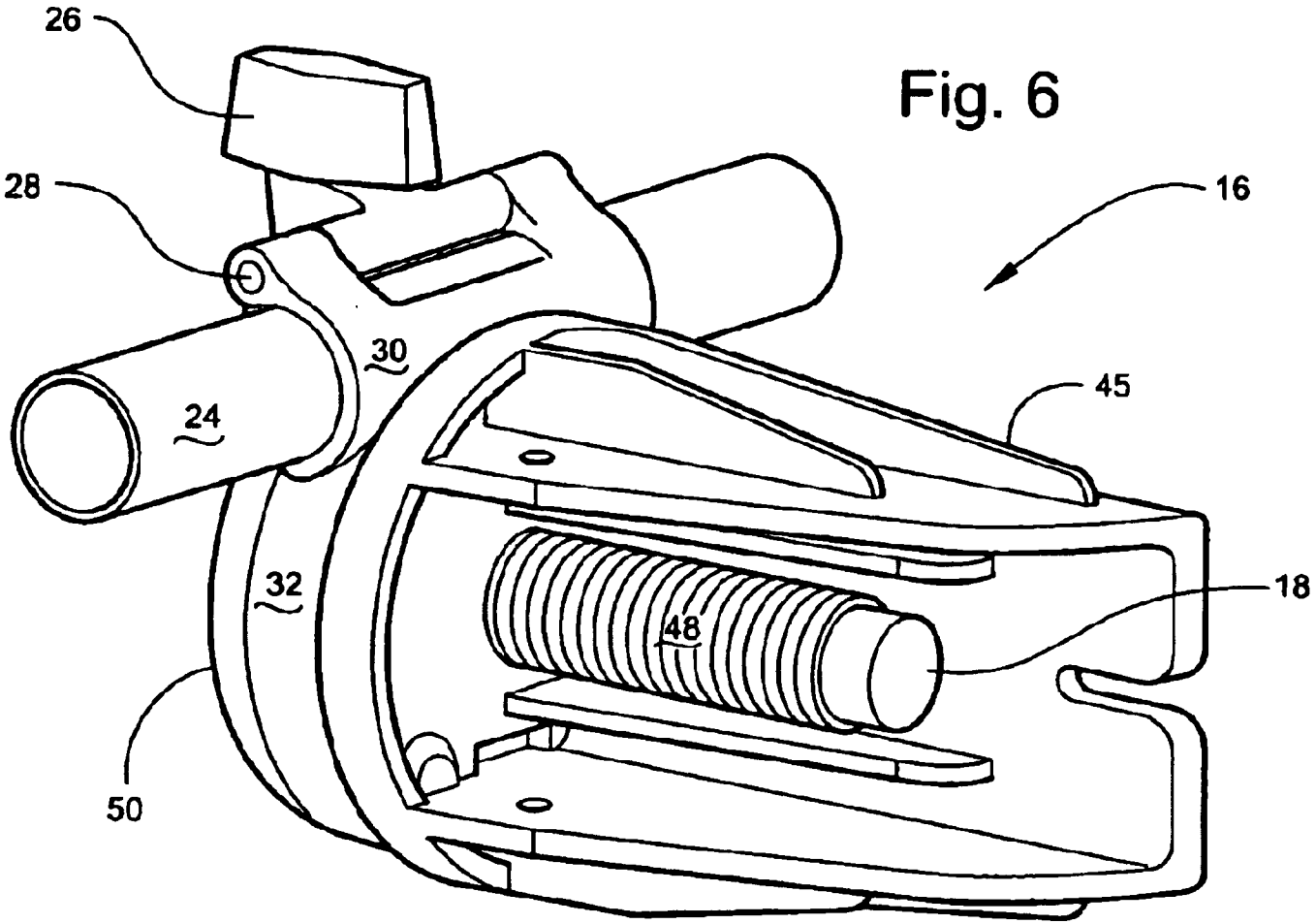
FIG. 6 is a downward perspective view of the mounting mechanism of the present invention with the release lever being removed to disclose the spring holding member and the spring carried thereby.
Figure 7:
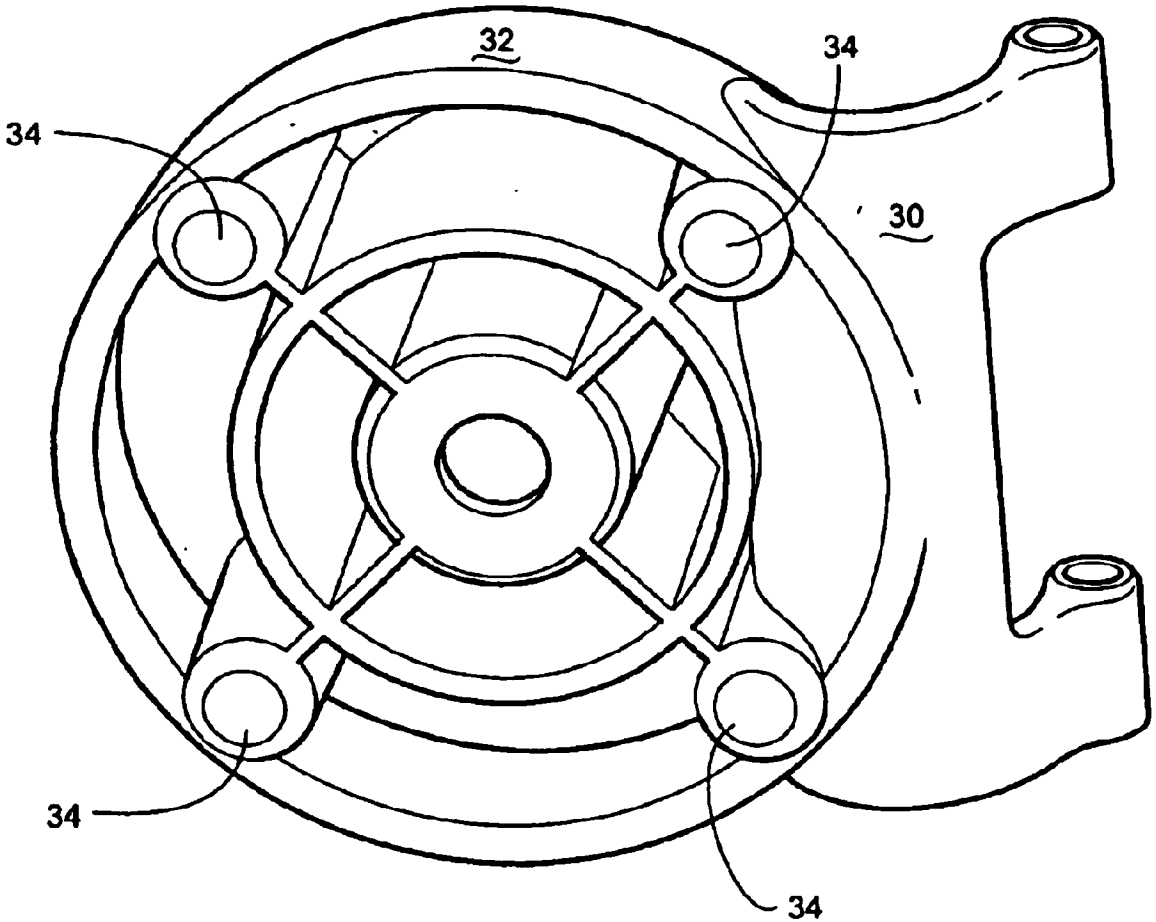
FIG. 7 is a perspective interior view of the rotor of the present invention.
Figure 8:
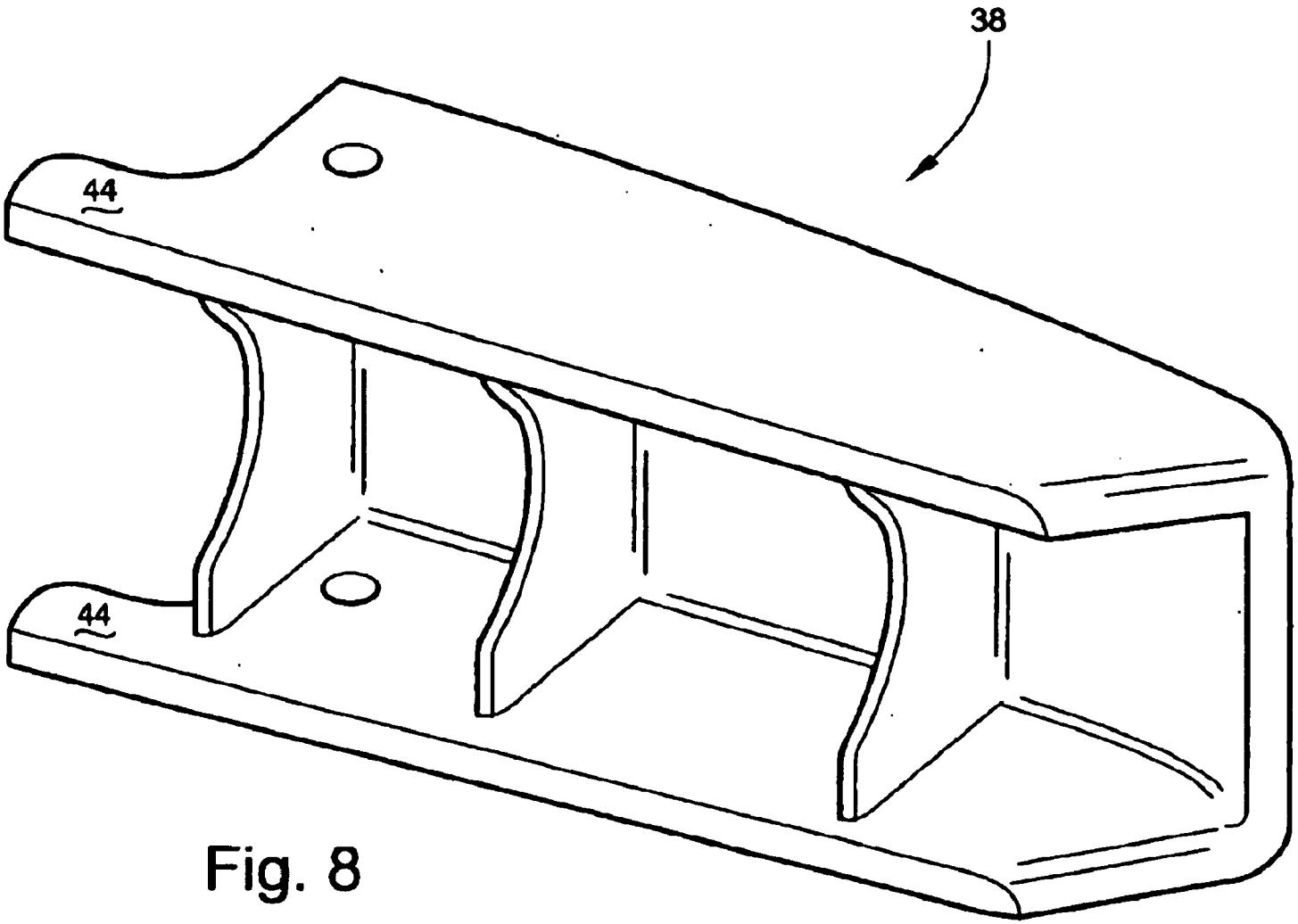
FIG. 8 is a perspective view of the release lever of the present invention.
Figure 9:
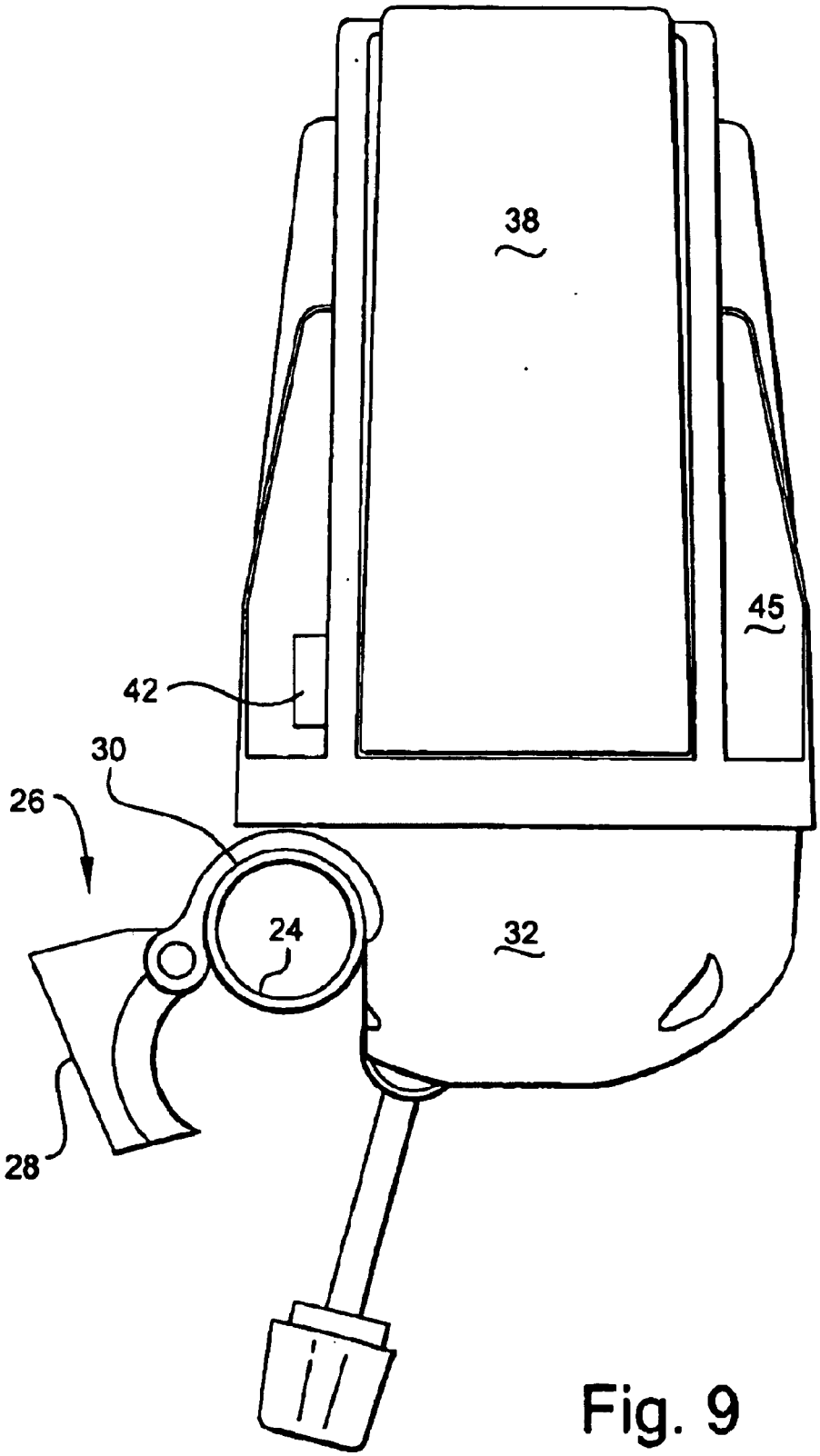
FIG. 9 is a top plan view of the of the present invention showing the motor shaft clamp mechanism in an open position allowing the removal of the motor.
Figure 10:
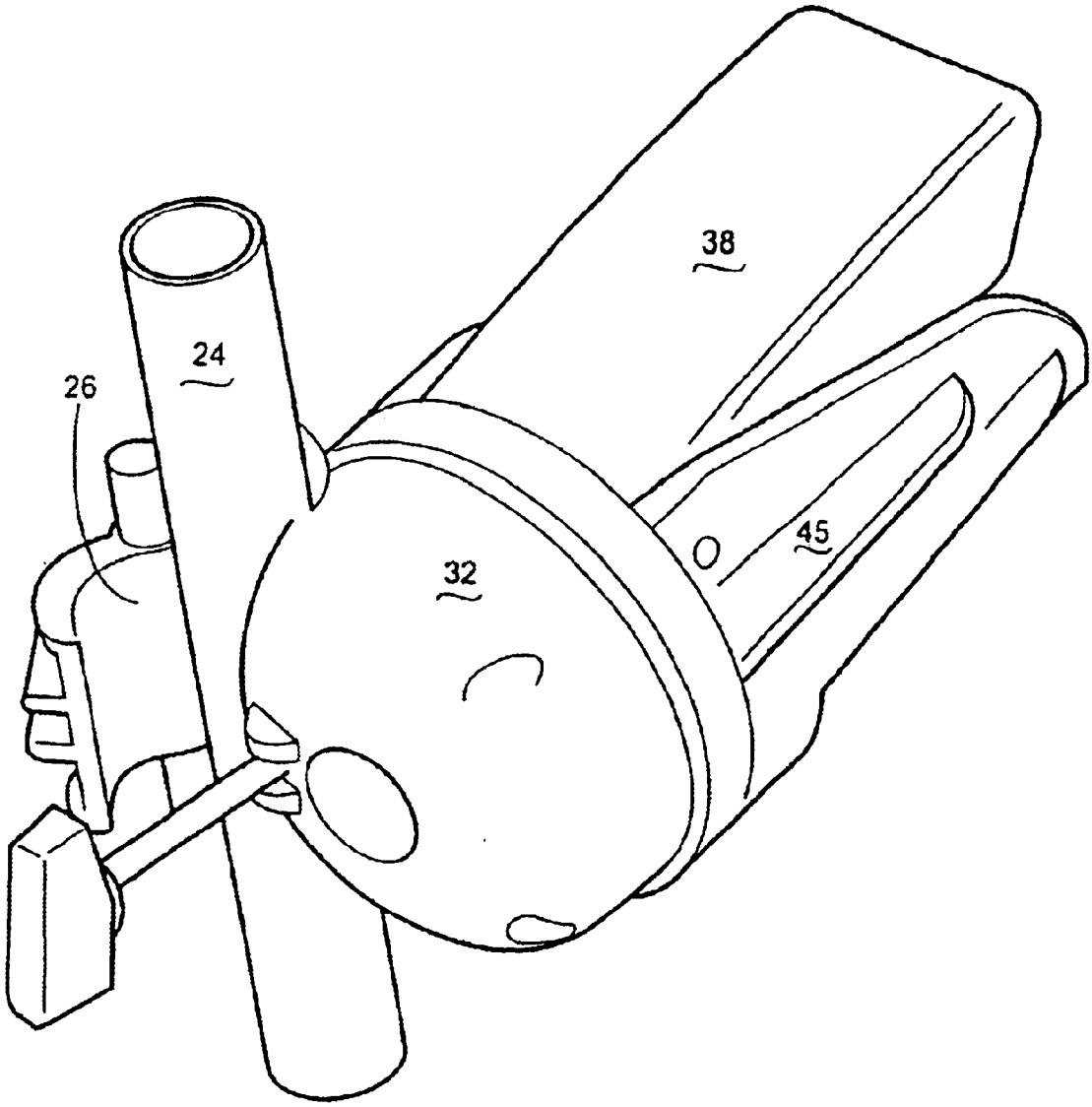
FIG. 10 is a downward perspective view also showing the motor shaft clamp in an open position.

As shown in FIG. 6, an elongated motor shaft 24 engages a clamp 26 which is pivotally connected by hinge 28 to a clamp engaging member 30 integrally formed with rotor 32. Rotor 32 also has a plurality of stator connecting elements 34 (FIG. 7) that cooperatively engage stator connecting elements 36 (FIG. 4) when shaft 24 is in a fixed and non-movable condition. In this embodiment of the invention, the rotor connecting elements are shown as protrusions 34 and stator 32 connecting elements are shown in FIG. 4 as recesses which cooperatively receive and connect with protrusions 34. Any one of a number of alterative fastening devices may be used, it not being intended to restrict this part the invention to any specific device or shapes. Obviously, the protrusion/recess combination set forth in this embodiment might be reversed wherein recesses would be in the rotor and protrusions in the stator. A release lever 38 is shown in the extended position and a rotor/stator connected position are shown in FIG. 4. Release lever 38 is shown in the depressed and rotor and stator disconnected position in FIG. 5. When lever 38 is depressed, it rotates about pin 42 so that release lever projections 44 extend outwardly and upwardly to engage the interior surface 50 of rotor 32.

Stator 45 is shown without lever 38 in FIG. 6. A spring holding member 18 extends through rotor 32 and into stator 45 as shown. It is preferably threadably secured to rotor 32 by a helical spring 48. Spring 48 is biased to hold the rotor connecting protrusions 34 within the stator connecting protrusion recesses 36 and maintain motor shaft 24 and carried motor and propeller mechanism 20, 22 in one or more fixed non-movable positions. When lever 38 is depressed, lever projections 44 engage the inside surface 50 of rotor 32, override the bias of spring 48 and displace stator 45 away from rotor 32 so that protrusions 34 are disengaged from recesses 36 and shaft 24 and its carried motor 20 and propeller mechanism 22 can be rotated around spring holder 18.

Thus when protrusions 34 are seated in recesses 36 as shown in FIG. 4, shaft 24 and its carried motor 20 and propeller mechanism 22 are rigidly fixed in a stationary position. When release lever 38 is depressed, projections 44 engage the interior surface 50 of rotor 32 and disconnect projections 34 from recesses 36 as shown in FIG. 5. In this condition, shaft 24, carried motor 20 and propeller mechanism 22 can be freely rotatable about spring holding member 18 to move motor 20 and propeller mechanism 22 into and out of the water.

When mechanism 16 is in the rotor/stator connected mode as shown in FIG. 4, motor 20 and propeller mechanism 22 are in the water in a force exerting position. If the motor is active and propeller mechanism 22 engages an unforeseen object beneath the surface of the water, the force of the impact will disconnect protrusions 34 from recesses 36 by overriding the bias of spring 48. Thus, shaft 24 is pivoted about pivot point 18 and motor 20 and propeller mechanism 22 are lifted out of the water and away from the struck submerged object. Shaft 24, motor 20 and propeller mechanism 22 will remain in the angled and non-vertical position they assumed after impact until shaft 24 is manually or gravitationally rotated about pin 18 and motor 20 and propeller mechanism 22 re-enter the water.

In view of the foregoing, it is evident that the present invention is one well adapted to attain all of the objects and features herein above set forth together with other objects and features which are inherent in the apparatus disclosed herein. As will be readily apparent to those skilled in the art, the present invention may be produced in other specific forms without departing from its spirit or essential characteristics. The present embodiment is therefore to be considered as a illustrative and not restrictive, the scope of the invention being indicated by the claims rather than the foregoing description. All changes which come within the meaning and range of the equivalent of the claims are therefore intended to be embraced therein.

What is claimed is:

1. A yieldable protective mounting mechanism for a motor mounted at an extended end of a shaft for supporting and positioning the shaft, the motor and the propeller mechanism, the mounting mechanism comprising: clamp means releasably secured to the shaft; a rotor having stator connecting elements and a clamp engaging member; a stator having rotor connecting elements and a release lever receiving portion; a spring holding member extending from the rotor into the stator; a spring supported by the spring holding member and biased to hold the rotor connecting elements within the cooperatively connecting stator elements and maintain the shaft, the motor and the propeller mechanism in a force exerting condition; and a release lever movably connected to the stator and normally biased by the spring to an extended and stator and rotor connected position.

2. The mounting mechanism as claimed in claim 1 wherein the spring bias is overcome when the motor, propeller mechanism or shaft strikes an object, the rotor connecting elements are dislodged from the stator connecting elements and the shaft, motor and propeller mechanism are displaced from the struck object.

3. The mounting mechanism as claimed in claim 2 wherein the shaft, motor and propeller mechanism displacement is rotational about the location of the clamp means and the rotor clamp engaging members.

4. The mounting mechanism as claimed in claim 2 wherein the clamp means is releasably secured to the rotor clamp engaging member.

5. The mounting mechanism as claimed in claim 4 wherein the release lever is movable to a depressed and rotor and stator disconnected position to disconnect the rotor connecting elements from the stator connecting elements and permit displacement of the shaft, motor and the propeller mechanism.

6. The mounting mechanism as claimed in claim 5 wherein the spring holding member extends through the rotor and into the stator.

7. The mounting mechanism as claimed in claim 5 wherein the shaft, motor and propeller mechanism is rotational about the location of the secured clamp means and the rotor clamp engaging member.

8. The mounting mechanism as claimed in claim 7 wherein the spring holding member extends through the rotor and into the stator.

9. The mounting mechanism as claimed in claim 8 wherein the rotor clamp engaging member is pivotally connected to the clamp means.

10. The mounting mechanism as claimed in claim 5 where the shaft, motor and propeller mechanism displacement is rotational about the location of the secured clamp means and the rotor clamp engaging members.

11. The mounting mechanism as claimed in claim 2 wherein the release lever is movable to a depressed and rotor and stator disconnected condition to disconnect the rotor elements from the stator connecting elements and permit displacement of the shafts, the motor and propeller mechanism from the force exerting condition.

12. The mounting mechanism as claimed in claim 2 wherein the rotor clamp engaging member is pivotally connected to the clamp means.

13. The mounting mechanism as claimed in claim 1 wherein the clamp means is releasably secured to the rotor clamp engaging member.

14. The mounting mechanism as claimed in claim 1 wherein the release lever is movable to a depressed and rotor and stator disconnected position to disconnect the rotor connecting elements from the stator connecting elements and permit displacement of the shafts, motor and propeller mechanism from the water.

15. The mounting mechanism as claimed in claim 14 wherein the spring holding member extends through the rotor and into the stator.

16. The mounting mechanism as claimed in claim 14 wherein the shaft, motor and propeller mechanism displacement is rotational about the location of the clamp means and the rotor clamp engaging member.

17. The mounting mechanism as claimed in claim 1 wherein the spring holding member extends through the rotor and into the stator.

18. The mounting mechanism as claimed in claim 1 wherein the rotor clamp engaging member is pivotally connected to the clamp means.

19. A yieldable protective mounting for a motor mounted at an end of an elongated shaft for support and positioning of the shaft, the mounting comprising: clamp means releasably secured to the shaft; a rotor having stator connecting elements and a clamp engaging member; a stator having rotor connecting elements and a release lever receiving portion; a spring holding member extending from the rotor into the stator; a spring supported by the spring holding member and biased to hold the rotor connecting elements within the cooperatively connecting stator elements and maintain the shaft, motor and the propeller mechanism in a force-exerting condition; and a release lever movably connected to the stator and normally biased by the spring to an extended and stator and rotor connected position.

* * * * *